United States Patent [19]

Clauss

[11] Patent Number: 4,531,930

[45] Date of Patent: Jul. 30, 1985

[54] PROCESS FOR THE PREPARATION OF A PAPER CONTAINER EQUIPPED WITH A REINFORCING RING, AND A REINFORCING RING FOR SUCH PROCESS

[75] Inventor: Gerhard Clauss, Donzdorf, Fed. Rep. of Germany

[73] Assignee: Michael Horauf Maschinenfabrik GmbH & Co. KG, Sussen, Fed. Rep. of Germany

[21] Appl. No.: 530,637

[22] Filed: Sep. 9, 1983

[30] Foreign Application Priority Data

Jun. 25, 1983 [DE] Fed. Rep. of Germany ..... 3322976

[51] Int. Cl.[3] ..... B65D 5/64

[52] U.S. Cl. ..... 493/108; 493/308; 220/359; 229/5.5; 229/4.5

[58] Field of Search ..... 493/102, 108, 274, 297, 493/308; 156/309.9; 53/453; 229/4.5, 5.5; 220/359

[56] References Cited

U.S. PATENT DOCUMENTS

| | | | |
|---|---|---|---|
| Re. 26,110 | 11/1966 | Harrison et al. | 156/184 |
| 3,734,393 | 5/1973 | Stump | 229/5.5 |
| 4,241,864 | 12/1980 | Kessler | 229/5.5 |
| 4,305,771 | 12/1981 | McLaren | 229/5.5 |

FOREIGN PATENT DOCUMENTS

| | | | |
|---|---|---|---|
| 2322803 | 1/1977 | France | 493/108 |
| 70249 | 4/1946 | Norway | 493/108 |
| 1138132 | 12/1968 | United Kingdom | 156/309.9 |
| 116346 | 5/1961 | U.S.S.R. | 156/309.9 |

*Primary Examiner*—Francis S. Husar
*Assistant Examiner*—Jorji M. Griffin
*Attorney, Agent, or Firm*—Burns, Doane, Swecker & Mathis

[57] ABSTRACT

In wound, preferably cylindrical paper containers, reinforcing rings of a synthetic plastic material are applied to the upper and possibly to the lower cut edges and joined by welding with the jacket. In order to insure that the core of the ring remains cold during welding and only the surface becomes liquid, thin-walled projections are provided in locations of the ring where welding is desired and are rendered flowable immediately prior to the placing of the ring on the jacket. Thus, the ring retains its structural integrity while being rendered weldable.

4 Claims, 5 Drawing Figures

10
12
9
8
11
2
1
3
4
5
6
23
15
7
16
14
13

12
8
9
10
11
17

12
8
9
10
19
11
18

12
9
10
11
20
8

22
13
21
16
15
14

PROCESS FOR THE PREPARATION OF A PAPER CONTAINER EQUIPPED WITH A REINFORCING RING, AND A REINFORCING RING FOR SUCH PROCESS

BACKGROUND AND OBJECTS OF THE INVENTION

The invention concerns the production of a paper container of a sealable cardboard material, equipped with a reinforcing ring.

In such containers a bottom is inserted into a wound jacket and to the upper cut edge of the open side of the container a reinforcing ring of a synthetic plastic material is applied. The ring is in contact with both the inner and the outer surface of the jacket.

A paper container prepared by a process of the aforementioned type is known from French Pat. No. 23 22 802. In that patent, a synthetic plastic ring is applied to the upper cut edge of the container on its open side, which is intended to provide the paper container with a certain stability. This plastic ring may grip the upper cut edge both from the outer and the inner side. The application of this plastic ring utilizes the elastic deformation of the jacket, which is temporarily expanded by means of a suitable mandrel and subsequently contacts the ring. Both the reinforcing ring and the jacket must have a slightly conical configuration such that the upper diameter of the container is smaller than its bottom diameter. The field of application of such a conical paper container is very limited. Furthermore, there is no assurance that an adequate seal is provided between the jacket and the reinforcing ring. Attempts have, therefore, been made to weld the plastic reinforcing ring into the jacket. However, as these rings are relatively thick compared with the wall thickness of the material, there are always difficulties in welding. In the course of the welding process, the plastic rings were plastically deformed and were softened to the extent that they lost their configuration accuracy. Containers of this type and the corresponding preparation process have thus not been accepted in practice.

It is the object of the invention to enable reinforcing rings to be welded tightly to the jacket, without encountering the disadvantages found in actual practice of the deformation of the rings during the welding process.

SUMMARY OF THE INVENTION

The invention comprises a process wherein only portions of the areas of the reinforcing ring are rendered weldable by heating immediately prior to the insertion. By such an operation it is obtained that only the surface of the reinforcing ring to be joined to the jacket becomes flowable, while the core of the ring remains cold, so that the ring retains the accuracy of its shape and remains stable. Only partial areas, which may have a special configuration, are melted and are easily welded to the coated paper. The ring itself remains unaffected.

Such a partial heating may be effected, for example, in that thin walled projections of the plastic ring are exposed prior to the application of the ring to hot air, which heat application may occur several times successively at three or four successive work stations. The plastic ring itself, in view of the short heating time, is not heated to its softening point. In spite of this short cycle time enough heat may be imparted to the thin-walled projections to soften them to weldability prior to insertion.

The invention also comprises a reinforcing ring whereby the partial areas to be heated have the configuration of weld lamellas having a large surface to volume ratio and protruding from the surface. The weld lamellas are preferably provided in all of the locations where molten or softened plastics are required for welding. The weld lamellas lose their structure after welding. It was found in the case of polyethylene weld lamellas that in the exposure to hot air, cycles of 150 per minute may be obtained. Because of their large surface, the weld lamellas rapidly attain their softening temperature during their exposure to hot air, while the core itself of the plastic reinforcing ring remains cold. Obviously, a plastic ring of this type may be placed not only on the upper edge of the container but also on the bottom edge, where it may encompass the beaded edge of a bottom.

It is advantageous to apply the weld lamellas to the area of the plastic ring associated with the inner surface of the jacket. As the finished containers are often filled with a liquid and covered with a lid, it is important that the containers be tight with respect to such liquids. For this reason, the reinforcing ring must be capable of being welded liquid-tight, in particular, to the inner surface of the jacket and also gas-tight in view of the preservation of the contents.

Depending on the configuration of the container, the lamellas may also be of different shapes. Thus, it may be appropriate to use weld lamellas in the form of annular ribs which surround the plastic ring. These annular ribs may be arranged in the form of a thread. Alternatively, the weld lamellas may be projecting in the outward direction in the form of annular conical ribs from the reinforcing ring, whereby a larger external surface is attained with the same outer circumference. For plastic reinforcing rings intended for the bottom of the container it is advantageous to provide additionally a cylindrical lamella associated with the bottom, which is joined not only with the beaded border of the bottom but also with the bottom surface itself. It is possible in the case where the plastic ring is to be welded to the external surface of the container jacket to also equip it with a weld lamella resting against the external surface of the jacket, with the external lamellas preferably being in the form of a cylindrical ring surrounding the sleeve-like part of the plastic ring radially at a distance.

THE DRAWING

The objects and advantages of the invention will become apparent from the following detailed description of preferred embodiments thereof, in connection with the accompanying drawings, in which like numerals designate like elements and in which.

DETAILED DESCRIPTION OF PREFERRED EMBODIMENTS OF THE INVENTION

Figure 1:
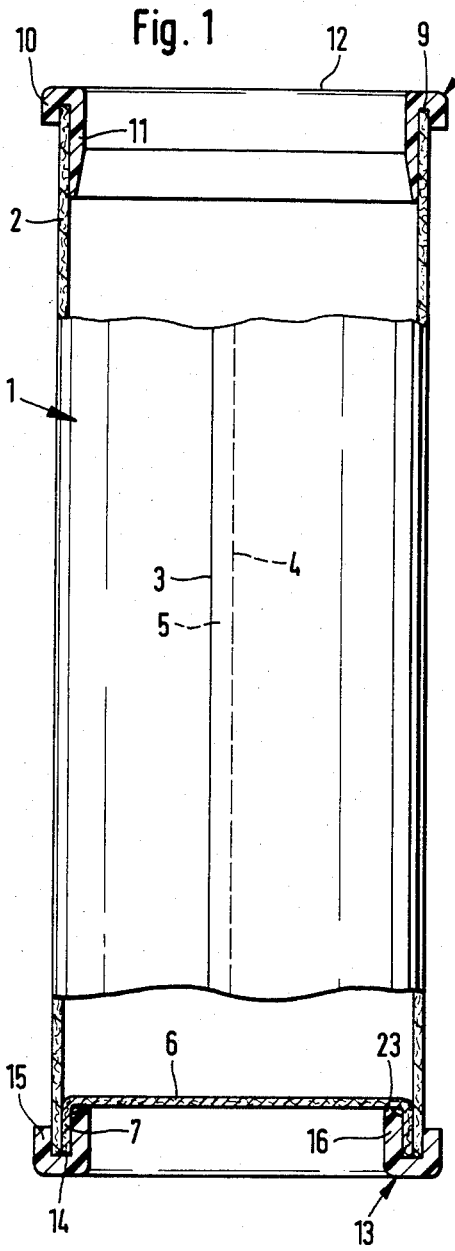
FIG. 1 is a longitudinal sectional view through a wound paper container with plastic reinforcing rings applied to the top and bottom according to the invention.

The cylindrical paper container 1 of FIG. 1 has a wound jacket 2, provided at least on its inner side with a sealable and fluid-tight coating. The symbol 3 designates the cut edge running at the generating line on the outside after the winding of the jacket 2, with which an inner cut edge 4 is associated so that an overlap 5 is obtained.

Into the wound jacket 2 a bottom 6, sealably coated on both sides, is inserted, the bottom being equipped with a cylindrical beaded border 7, which is abutting against the cylindrical inner surface of the jacket 2.

To increase the stability and to form a sealing border of the paper container 1, a plastic reinforcing ring 8 is placed on the upper, open cut end edge of the jacket 2, the reinforcing ring having for the purpose a circular annular groove. The reinforcing ring 8 has a short sleeve-like area 10, whereby it contacts the outer surface of the jacket 2, and a longer sleeve-like area 11, whereby it abuts against the inner surface of the jacket 2. The reinforcing ring 8 has on top a support surface 12, to which after the filling of the container 1 with a liquid, a lid for example of aluminum foil, may be applied.

A further reinforcing ring 13 of a synthetic plastic material is provided for the lower open end edge of the jacket 2, the ring 13 also having a circular groove 14 which is slightly wider than the groove 9 of the upper reinforcing ring 8. The lower reinforcing ring 13 is placed in a positively locking manner both over the open lower cut edge of the jacket 2 and the open lower cut edge of the beaded border 7 of the bottom 6. The reinforcing ring 13 has a sleeve-like configuration and is in contact with one sleeve-like surface 15 with the outer surface of the jacket 2 and with a sleeve-like surface 16 with the inner surface of the beaded border 7 of the bottom 6.

To be able to weld the reinforcing rings 8 and 13 together with the jacket 2 and the bottom 6 so that the container 1 subsequently will have the appearance shown in FIG. 1, the reinforcing rings 8 and 13 have a configuration as illustrated in FIGS. 2 to 5 prior to welding.

To insure that the reinforcing ring 8 during the welding to the jacket 2 remains cold for reasons of stability and softens only at the surface to be welded, the ring includes a plurality of thin projections in the form of three ring-like weld lamellas 17 which are fastened to the area associated with the inner surface of the jacket 2. The lamellas 17 are very thin-walled and have a high surface area compared with their volume. In that regard, the ratio of surface area to volume of the lamellas is greater than such ratio for the remaining portions of the ring. The weld lamellas 17 are significantly thinner than the rest of the wall of the plastic ring 8 and protrude outwardly in the manner of ribs from the sleeve-like area 11. The weld lamellas 17 melt upon heating by hot air prior to their placement on the jacket 2 or at least become soft enough to be plastically deformable. Following the insertion of the plastic ring 8 in the container jacket 2 their shape is no longer recognizable.

Figure 2:
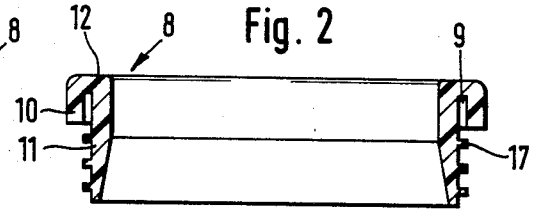
FIG. 2 is a longitudinal sectional view through a first embodiment of an upper reinforcing ring having blunt rib or disk-like weld lamellas.
Figure 3:
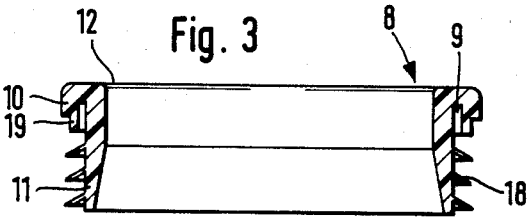
FIG. 3 is a longitudinal sectional view through a second embodiment of a reinforcing ring having weld lamellas with a conical outer surface.

The configuration of the reinforcing ring 8 according to FIG. 3 differs from the configuration according to FIG. 2 in that annular melt lamellas 18 of a different shape are provided; they have a conical outer surface and possibly a conical inner surface. The surface area is thereby increased while the outer diameter remains constant, effecting an even better sealing after the welding of the plastic ring 8 into the jacket 2. Additionally, a further melt lamella 19 is applied to the area 10 of the plastic ring 8 associated with the outer surface of the jacket 2; the lamella 19 having a cylindrical configuration and coaxially surrounding the sleeve-like area 11 at a radial distance.

Figure 4:
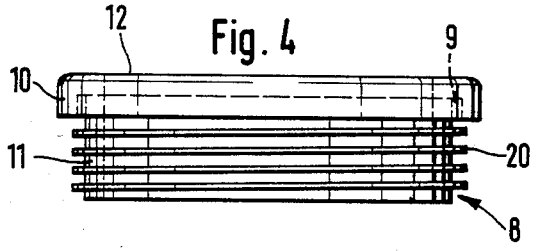
FIG. 4 is a longitudinal sectional view through a third embodiment of a reinforcing ring having weld lamellas arranged in the form of a thread.

The configuration according to FIG. 4 corresponds essentially to the embodiment according to FIG. 2, with the single exception that the annular lamella 20 in this case are arranged as a helical thread. For better visualization, the plastic ring 8 according to FIG. 4 is shown in a lateral view, while the rest of the examples of embodiment 2, 3 and 5 are drawn in cross-section.

Figure 5:
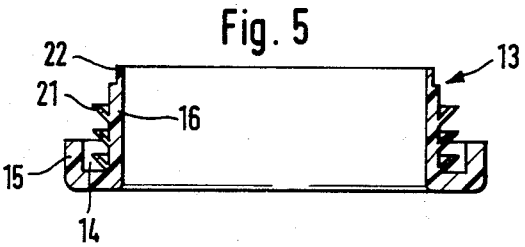
FIG. 5 is a longitudinal sectional view through a plastic ring associated with the bottom of the container.

The plastic ring 13 according to FIG. 5 serves to cover the lower cut edge of the jacket 2 associated with the bottom 6 and the cut edge of the beaded edge 7 of the bottom 6. For this reason, the circular groove 14 is wide enough to be sufficient for at least two wall thicknesses. Otherwise, the configuration of the lower plastic ring 13 corresponds to the variant according to FIG. 3, i.e., the melt lamellas 21 again have a conical outer surface and are directed against the bottom 6. The underside of the bottom 6 is associated with an additional thin-walled, hollow cylindrical melt lamella 22 of the plastic ring 13, which is joined by welding at 23 with the bottom 6. This results in an additional sealing of the finished paper container 1.

In the production of the new container, (i) the jacket 2 is wound, (ii) the bottom 6 is inserted, and (iii) the two reinforcing rings 8 and 13 are installed. Both the reinforcing ring 8 and the reinforcing ring 13 are heated prior to the application to the container edges by being blown with hot air so that only the outwardly projecting melt lamellas 17 to 20 and 21 and 22 are heated to the extent that they are capable of flowing. This is effected in that the lamella in several work stations, preferably in three to four subsequent work stations, are exposed directionally to a flow of hot air, so that they assume a flowable and weldable state only shortly prior to installation. When the rings 8 and 13 are then placed onto the container edges and slightly pressured, the reinforcing rings 8 and 13 are joined by welding with the container jacket 2 tightly and permanently. The form of the reinforcing rings 8 and 13 is not affected by this heating step, as the sleeve-shaped areas 10 and 11 and 15 and 16, respectively, which have thicker walls, are not heated during the blow of hot air to the extent that they can be deformed.

The heating of the projections may be accomplished progressively at 3 or 4 work stations. The projections, of course, lose their structure after welding. It was found in the case of polyethylene projections that during the exposure to hot air, cycles of 150 per minute could be produced. Because of their large surface to volume ratio, the projections rapidly attain their softening temperature during their exposure to hot air, while the core of the ring remains cold. Accordingly, the ring will retain its structural integrity even though becomming weldable.

Although the present invention has been described in connection with preferred embodiments thereof, it will be appreciated by those skilled in the art that additions, modifications, substitutions, and deletions not specifically described may be made without departing from the spirit and scope of the invention as defined in the appended claims.

What is claimed is:

1. A process for producing a paper container comprising the steps of:

winding a jacket of sealable cardboard material such that said jacket includes inner and outer surfaces and upper and lower edges, inserting a bottom element into said lower edge, providing a reinforcing ring of a synthetic plastic material and having inner and outer surface portions, said inner surface portion including outwardly projecting thin-walled projections, applying heat to said ring such that said projections are rendered plastically deformable, while remaining areas of said inner surface portion remain below the plastic deformation temperature, thereafter placing said ring onto said upper edge of said jacket such that said inner and outer surface portions of said ring contact said inner and outer surfaces, respectively, of said jacket, and such that the structure of said projections is destroyed.

2. Process according to claim 1, wherein said heating is accomplished by the blowing of hot air.

3. Process according to claim 2, wherein said blowing of hot air is preformed at successive work stations to progressively heat said portions of said ring.

4. Process according to claim 1, wherein an additional reinforcing ring of a synthetic plastic material is placed onto said lower edge of said jacket, and prior to such placement, portions of said additional ring are softened by being heated so as to render only such portions weldable upon placement of said additional ring onto said jacket.

* * * * *